US005280913A

United States Patent [19]

Sirk

[11] Patent Number: 5,280,913

[45] Date of Patent: Jan. 25, 1994

[54] APPARATUS AND METHOD OF PLAYING DOUBLE CHESS GAME

[76] Inventor: Michael W. Sirk, Rte. 4, Box 358-C, Wildwood, Fla. 34785

[21] Appl. No.: 12,394

[22] Filed: Feb. 2, 1993

[51] Int. Cl.[5] ..... A63F 3/02; G09B 19/22; B65D 85/57

[52] U.S. Cl. ..... 273/261; 273/285; 273/286; 273/287; 434/128; 434/318; 206/311; 206/312

[58] Field of Search ..... 273/261, 260, 285, 286, 273/287, 282.1, 282.2, 282.3, 239; 434/128, 129, 309, 310, 311, 318, 319; 206/311, 312, 313, 309

[56] References Cited

U.S. PATENT DOCUMENTS

| | | | |
|---|---|---|---|
| 511,306 | 12/1893 | Moore | 273/283 |
| 2,309,494 | 1/1943 | Berg | 273/282.1 |
| 2,610,060 | 9/1952 | Powell | 273/255 |
| 3,610,626 | 10/1971 | Nolte | 273/261 |
| 3,825,267 | 7/1974 | Rubinoff | 273/261 |
| 4,190,254 | 2/1980 | Leeds | 273/261 |
| 4,541,633 | 9/1985 | Newbill | 273/238 |
| 4,572,513 | 2/1986 | Evans | 273/242 |
| 4,708,349 | 11/1987 | Shomer | 273/261 |
| 4,778,187 | 10/1988 | Deak | 273/261 |
| 4,856,789 | 8/1989 | Carlson | 273/261 |
| 4,932,669 | 6/1990 | Perry | 273/261 |

FOREIGN PATENT DOCUMENTS

| | | | |
|---|---|---|---|
| 1189106 | 6/1985 | Canada | 273/260 |
| 1484250 | 9/1977 | United Kingdom | 434/318 |
| 2201351 | 9/1988 | United Kingdom | 273/260 |

OTHER PUBLICATIONS

Kunststoffe German Plastics; H. Marxmeier, Wuppertal; Jun. 1988.

Sears Christmas Season 1975 Catalog, Magnetic Chess Sets for outdoors, traveling, compact set p. 607.

*Primary Examiner*—Benjamin H. Layno

*Attorney, Agent, or Firm*—Wigman, Cohen, Leitner & Myers

[57] ABSTRACT

A modified chess game for play by two opposing players comprises a game board eight squares wide and sixteen squares deep, foldable at its midsection to create a carrying case for the pieces. Each player has a playing pieces set consisting of two kings, two queens, four rooks, four knights, four bishops and sixteen pawns. The pieces are positioned as in conventional chess, except that each row is doubled. Playing pieces are moved pursuant to conventional movements and rules of capture, except that pawns may advance two spaces at a time as long as they are in their own territory, and must reach the sixteenth row to be exchanged for any playing piece but the king. The game may be played so that a player wins by capturing both of his opponent's kings, or by capturing only one.

19 Claims, 2 Drawing Sheets

APPARATUS AND METHOD OF PLAYING DOUBLE CHESS GAME

BACKGROUND OF THE INVENTION

The present invention relates to board games and more particularly to improvements in chess games.

In traditional chess, two opposing armies face each other across a playing board of 64 equal squares, eight squares across and eight squares deep. The armies consist of eight foot soldiers called pawns, two rooks (castles), two knights, two bishops, a queen and a king. The rooks, knights, bishops, queen and king are collectively known as "royalty pieces."

The game ends immediately when one player captures the king. As a result, the duration of the game is often short, especially when one of the players is more experienced. Moreover, the popularity of chess notwithstanding, many players have become bored with the repetitiveness of the game.

To overcome these disadvantages, several variations to the game of chess have been suggested in the prior art. For example, U.S. Pat. No. 3,610,626 to Nolte discloses a chesslike game wherein the size of the playing area and the number of chess figures is increased.

Similarly, U.S. Pat. No. 4,856,789 to Carlson discloses a chess set comprising a game board fifteen squares wide and twelve squares deep for play by two teams of two players each. A key disadvantage of this type of game is the fact that while the number of game pieces is increased, the actual playing time afforded each player is no more than the playing time of a traditional chess game.

However, these and similar games have not achieved commercial success due in part to the fact that the rules by which these games are played differ from those of the traditional game of chess so as to make play unduly complicated for most players.

SUMMARY AND OBJECTS OF THE INVENTION

In view of the foregoing, it should be apparent that a need still exists in the art for a chess game for two players which increases the challenge and length of play of the traditional chess game without requiring the players to learn new rules or playing strategies.

Accordingly, it is a primary object of this invention to provide a chess game which doubles the playing surface of the traditional chess game.

Another object of this invention is to provide a chess game in which the number of playing pieces in each player's set is double that of the traditional chess game.

Yet another object of this invention is to provide a chess game which can be played without difficulty by players familiar with the rules of the traditional chess game.

A further object of this invention is to provide a chess game that is portable, compact, and easy to assemble.

Still another object of this invention is to provide a chess game wherein the game board further comprises a jacket for a record or compact disc recording of background music or game playing instructions.

These and other objects and advantages are accomplished by providing a chess game for two players having a playing surface of sixteen rows of eight squares each. A set of chess pieces double that of conventional chess is provided to each player. The playing surface is foldable at its midsection so as to create a carrying case for the pieces.

In a second embodiment, the playing surface is preferably provided with one or more pockets adapted to receive a record or compact disc upon which playing instructions and strategies and/or appropriate background music are provided. One pocket of the playing surface is also adapted to receive two sheets of paper or the like perforated with the outlines of the playing pieces. The pieces are to be detached at the perforations and folded so as to maintain an upright position during play.

With the foregoing and other objects, advantages and features of the invention that will become hereinafter apparent, the nature of the invention may be more clearly understood by reference to the following detailed description of the invention, the appended claims and to the several views illustrated in the attached drawings.

DETAILED DESCRIPTION OF THE INVENTION

Figure 1:
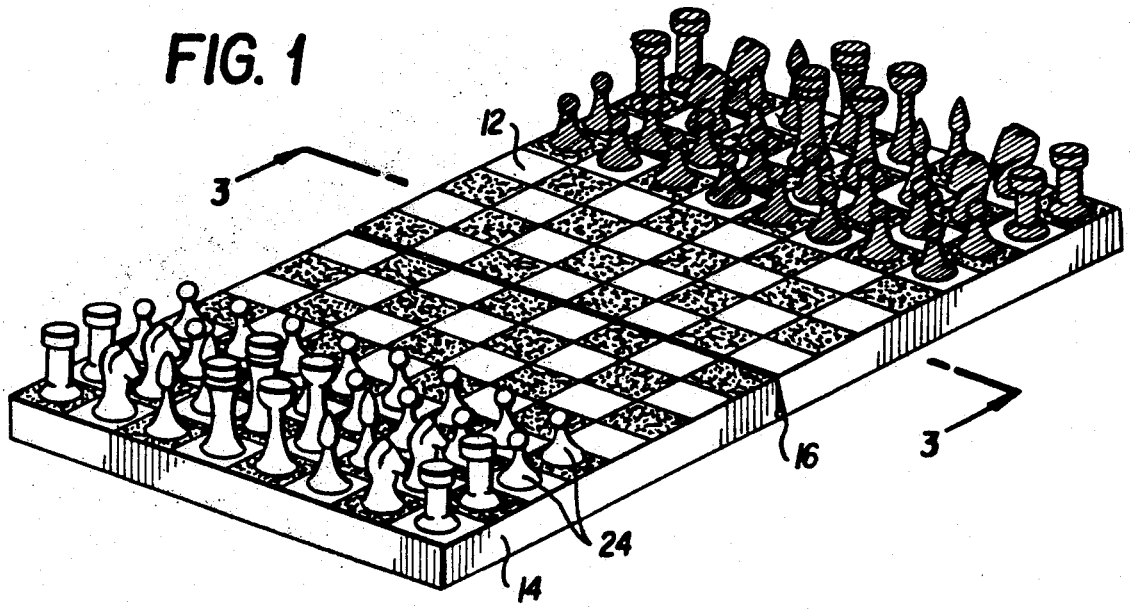
FIG. 1 is a perspective view of the first embodiment of the present invention as it is laid open during game play.

Referring now in detail to the drawings wherein like parts are designated by like reference numerals throughout, there is illustrated in FIG. 1 a perspective view of an embodiment of the present invention as it is arranged during game play designated generally by reference numeral 10.

Figure 3:
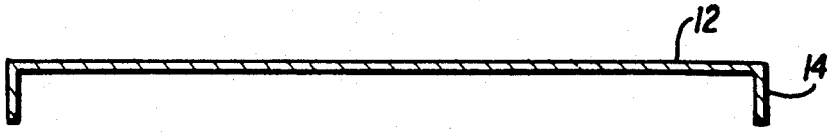
FIG. 3 is a sectional view of the game board of the present invention taken along line 3—3 of FIG. 1.

Game set 10 generally comprises a modified chess game having an enlarged playing surface and one set of thirty-two chess pieces for each player. The playing surface preferably constructed of wood, plastic, or other rigid material is foldable at its midsection so as to create a carrying case for the pieces. More particularly, game board 12 is eight squares wide and sixteen squares deep. As with a conventional chess or checkerboard, alternating squares are distinguished by contrasting colors, indicated by the hatched lines in the drawings. In a first embodiment, board 12 is segmented along its midline, wherein the sections are attached by a hinge 16. As best viewed in FIG. 3 vertical sides 14 depend from board 12 so as to define a recess in the underside of each section of the board.

Figure 2:
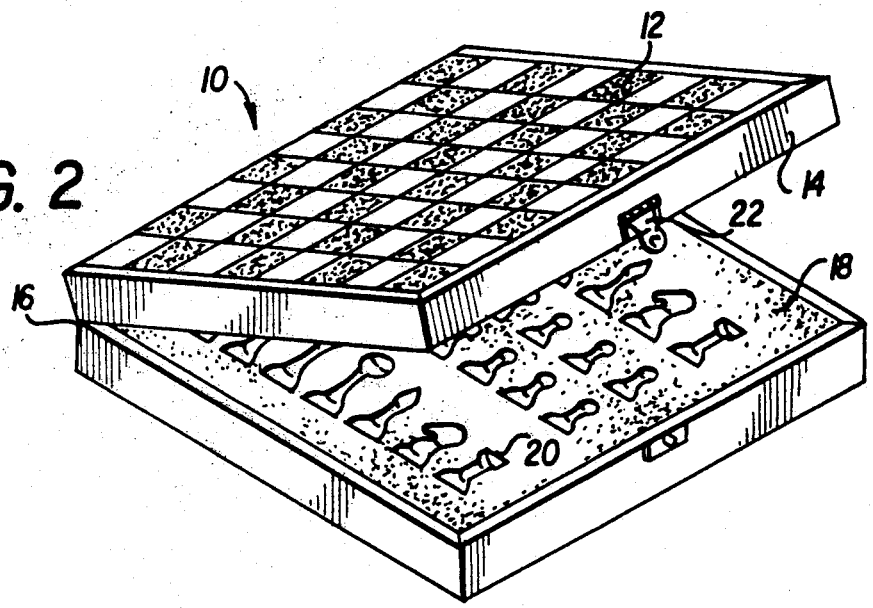
FIG. 2 is a perspective view of the present invention partially closed showing the recess cavities for the playing pieces.

As viewed in FIG. 2, the recesses defined in the underside of both sections are adapted to receive an insert 18 constructed of any suitable sponge-like material. Insert 18 defines a plurality of cut-outs 20 shaped to receive the chessmen during storage. A closure means 22 is provided to secure the two sections of the board when it is closed.

Each player is provided with a set of thirty-two playing pieces 24, visibly distinguishable from the other player's pieces by color or other means. Playing pieces 24 comprise sixteen pawns, four rooks, four knights, four bishops, two queens, and two kings. The pieces are positioned as in conventional chess, except that each row is doubled. Thus, for example, as illustrated in FIG. 1, in the first four rows of the first column two rooks adjacent to one another would be positioned behind two pawns.

Alternatively, the pieces may be set up so that rows of royalty pieces alternate with rows of pawns, rather than positioning both rows of royalty pieces behind both rows of pawns.

Figure 4:
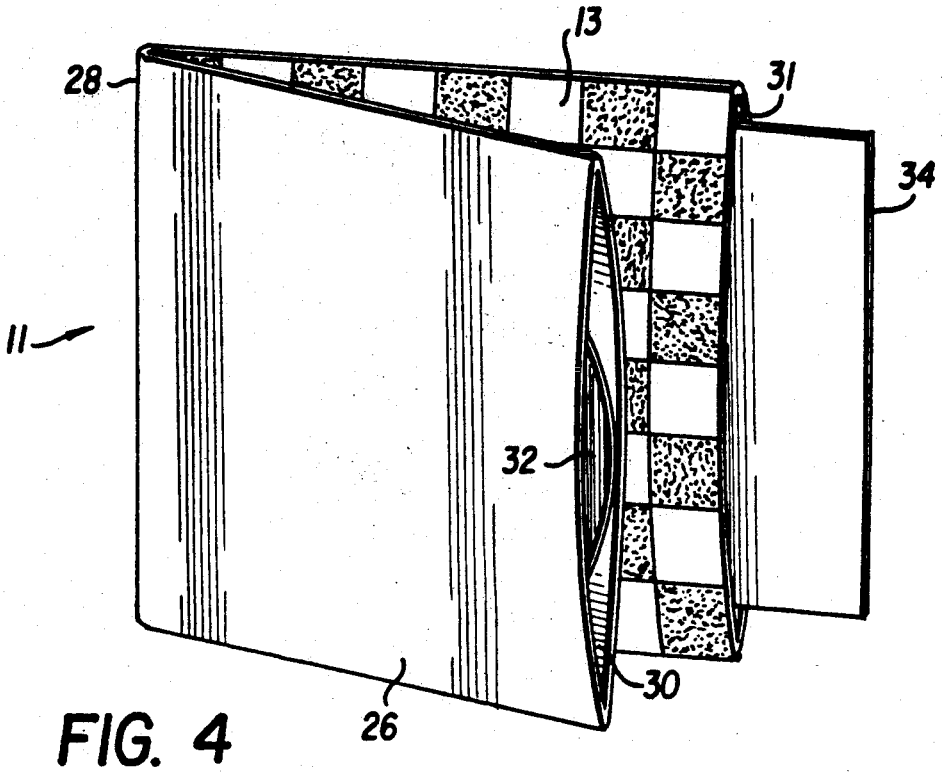
FIG. 4 is a perspective view of a second embodiment of the present invention provided with one or more pockets for records or compact discs.
Figure 5:
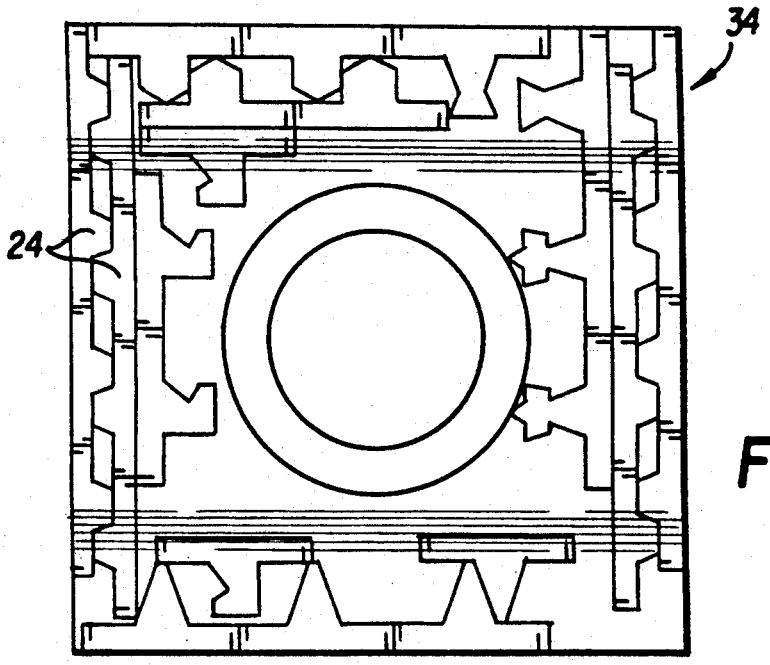
FIG. 5 is a perspective view of the perforated sheets of the second embodiment from which the playing pieces are formed.

In a second embodiment (FIG. 4), the playing board 11 preferably comprises a sleeve 26 constructed of cardboard or a similar lightweight material. Sleeve 26 is foldable about a midline crease 28 to define two pockets 30 and 31 with a combined thickness no greater than ¼". Pocket 30 is adapted to receive a record or compact disc 32. Pocket 31 is adapted to receive two sheets 34 made of paper or the like having perforated outlines of the set of thirty-two playing pieces, as shown in FIG. 5. Playing pieces 24 may be detached at the perforations and folded so as to maintain an upright position during play. Game board 13 is eight squares wide and sixteen squares deep, and is printed on the side of sleeve 26 that faces inward when folded. Playing pieces 24 are positioned on the board as described in connection with the first embodiment.

The rules of the game of both embodiments of the present invention, a substantial improvement to those of conventional chess, are described as follows: playing pieces are arranged as in conventional chess and are moved pursuant to conventional movements and rules of capture, with the sequence of moving playing pieces alternating between the two players. However, several important differences between the rules of conventional chess and those of the present invention exist. First, in order to win, a player must capture both of his opponent's kings, instead of capturing one king as in conventional chess. Consequently, unlike the traditional chess game where a king in check must be defended or moved out of check, one king may be left in check so long as both kings on that side remain on the board. This modification lengthens the time of play in comparison to the traditional chess game. Second, whereas in conventional chess the pawns may move two spaces forward only from their original starting space and only one space in all subsequent moves, in the present invention they may continue to advance two spaces at a time as long as they are in their own territory. In addition, pawns must reach the opposite side of the playing surface, i.e. the sixteenth row, to be exchanged for any playing piece but the king.

Alternatively, the game may be played as outlined above, but requiring that a player capture only one of the opponent's kings in order to win the game. Thus, a king in check must be defended or moved out of check as in traditional chess.

The game may also be played with simplified rules, wherein the pieces are positioned as outlined above, but may move across unoccupied spaces in any direction subject only to restrictions on the number of spaces each type of piece may move. Kings may move one space, queens may move five spaces, rooks may move four spaces, bishops may move three spaces, knights may move two spaces and pawns may move one spaces.

The rules and objectives of the second embodiment are the same as those of the first embodiment described above. However, the second embodiment is also provided with a record or compact disc containing a recording of music or instructions.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A modified chess game for two players consisting essentially of a rectangular shaped game board having sixteen rows and eight columns of checkered alternating colored squares, a first set of thirty-two chess pieces comprising a subset of royalty pieces consisting of two kings, two queens, four rooks, four knights and four bishops, and a subset of sixteen pawns, and a second set of thirty-two chess pieces, comprising a subset of royalty pieces consisting of two kings, two queens, four rooks, four knights and four bishops, and a subset of sixteen pawns, said first set being visibly distinguishable from said second set.

2. The chess game of claim 1 wherein said board is foldable at its midline so as to create a carrying case for the pieces.

3. The chess game of claim 1 wherein said board comprises a first section and a second section, substantially similar to said first section, and hingedly mounted thereto.

4. The chess game of claim 3 wherein the combined thickness of said first section and said second section is no greater than ¼", and further comprising an audio recording of music or chess-playing instructions.

5. The chess game of claim 4 wherein said audio recording is retained in a pocket defined in said board.

6. The chess game of claim 5 wherein said board is foldable at its midline so as to create a carrying case for said pieces and said audio recording.

7. The chess game of claim 4 wherein said audio recording is a compact disc.

8. The chess game of claim 1 wherein vertical sides depend from the board so as to define a recess in the underside of each section of the board.

9. The chess game of claim 4 wherein said recesses defined in the underside of both sections are adapted to receive an insert, constructed of any suitable sponge-like material, defining a plurality of cut-outs shaped to receive the playing pieces during storage.

10. The chess game of claim 1 and further comprising at least one sheet having perforated outlines of playing pieces.

11. The chess game of claim 10 wherein said at least one sheet is received in a pocket defined in said game board.

12. The chess game of claim 1 wherein said first said set is of a first color and said second set is of a second color different from said first color.

13. The chess game of claim 12, wherein said first color is black and said second color is white.

14. A method of playing chess comprising the steps of:

a. providing an enlarged game board including a playing area having sixteen rows and eight columns of checkered alternating colored squares;

b. providing a set of chess pieces comprising:

a subset of royalty pieces for each player consisting of two kings, two queens, four rooks, four knights and four bishops for each player, and a subset of sixteen pawn pieces for each player;

c. positioning each player set to form two royalty rows, as in conventional chess, along the two rows at opposite edges of said playing area and two pawn rows in front of the royalty rows; and d. moving the playing pieces pursuant to conventional movements and rules of capture, with the sequence of moving playing pieces alternating between the two players.

15. The method of playing chess according to claim 14 wherein pawn pieces may advance two spaces at a time as long as they are in their own territory.

16. The method of playing chess according to claim 15 wherein a player must capture both of the opponent's kings to win the game.

17. The method of playing chess according to claim 15 wherein a player must capture only one of the opponent's kings to win the game.

18. A method of playing chess comprising the steps of:

a. providing an enlarged game board including a playing area having sixteen rows and eight columns of checkered alternating colored squares;

b. providing a set of chess pieces comprising:

a. subset of royalty pieces for each player consisting of two kings, two queens, four rooks, four knights and four bishops for each player, and a subset of sixteen pawn pieces for each player;

c. positioning each player set to form two royalty rows, as in conventional chess, along two rows at opposite edges of said playing area and two pawn rows in front of the royalty rows;

d. moving the playing pieces wherein each player in turn moves one of the playing pieces across unoccupied spaces in any direction from one space on the board to another, according to the following restrictions: kings may move only one space per turn, queens may move only five spaces per turn, rooks may move only four spaces per turn, bishops may move only three spaces per turn, knights may move only two spaces per turn, and pawns may move only one space per turn;

e. moving the playing pieces wherein any player, during a turn and when desired, may move a playing piece according to said restrictions to a space occupied by an opponent's playing piece and subsequently thereto removing the opponent's piece as an indication that the opponent's piece has been captured.

19. The method of playing chess according to claim 18 wherein knights may move over occupied spaces.

* * * * *